United States Patent [19]

Toman

[11] 3,982,249

[45] Sept. 21, 1976

[54] MICROWAVE RADIATION METHOD AND APPARATUS WITH A COMBINED DIFFRACTION EDGE AND RADIATION SCREEN

[75] Inventor: Donald J. Toman, Pleasantville, N.Y.

[73] Assignee: Tull Aviation Corporation, Armonk, N.Y.

[22] Filed: May 30, 1975

[21] Appl. No.: 582,204

[52] U.S. Cl. ..... 343/841; 343/108 R; 343/753; 343/771; 343/909

[51] Int. Cl.[2] ..... H01Q 15/02; H01Q 1/52

[58] Field of Search ..... 343/705, 753, 841, 909, 343/912, 108 R, 771

[56] References Cited

UNITED STATES PATENTS

| | | | |
|---|---|---|---|
| 2,225,475 | 12/1940 | Hahnemann | 343/108 R |
| 2,538,035 | 1/1951 | Pickles | 343/108 R |
| 3,495,265 | 2/1970 | Smith | 343/753 X |
| 3,683,394 | 8/1972 | Smith | 343/841 |
| 3,815,138 | 6/1974 | Haley | 343/909 X |

FOREIGN PATENTS OR APPLICATIONS

| | | | |
|---|---|---|---|
| 323,237 | 9/1928 | United Kingdom | 343/841 |

OTHER PUBLICATIONS

Screening Fences for Ground Reflection Reduction, F. K. Priekschat, Microwave Journal, Aug. 1964, pp. 46–50.

*Primary Examiner*—Eugene La Roche
*Attorney, Agent, or Firm*—Curtis Ailes

[57] ABSTRACT

In a directional microwave signal radiation system, low angle radiation problems are dealt with by inserting a combined diffraction edge and radiation screen in the lower portion of the radiation field to provide a diffraction pattern of radiation at low and negative radiation angles beyond the diffraction edge.

15 Claims, 5 Drawing Figures

MICROWAVE RADIATION METHOD AND APPARATUS WITH A COMBINED DIFFRACTION EDGE AND RADIATION SCREEN

CROSS REFERENCES TO RELATED U.S. PATENTS

All of the following patents are assigned to the same assignee as the present application:

U.S. Pat. application Ser. No. 453,347 filed Mar. 21, 1974 issued on Jan. 6, 1976 as U.S. Pat. No. 3,931,624 by Warren Hundley and Michael A. Eovine for ANTENNA ARRAY FOR AIRCRAFT GUIDANCE SYSTEM.

U.S. Pat. No. 3,806,935 issued Apr. 23, 1974 to Donald J. Toman for a RADIO NAVIGATIONAL AID WITH SEPARATE STANDARD FREQUENCY SIGNAL.

U.S. Pat. No. 3,774,214 issued Nov. 20, 1973 to Donald J. Toman and Lloyd J. Perper for SCANNING BEAM GUIDANCE METHOD AND SYSTEM.

U.S. Pat. No. 3,793,597 issued Feb. 19, 1974 to Donald J. Toman for MODULATION SYNTHESIS METHOD AND APPARATUS.

U.S. Pat. No. 3,818,476 issued June 18, 1974 to Warren Hundley, J. Roland Coulter, and Sol N. Koblick for NAVIGATION AID TRANSMITTER-MONITOR SYSTEM.

This invention relates to microwave radiation systems, and particularly to directional microwave radiation systems which are especially useful in radio navigational aids such as instrument landing systems.

In the related U.S. Pat. No. 3,931,624 there is disclosed an antenna array for an aircraft guidance system which is particularly adapted for the transmission of localizer signals defining an azimuth course to be followed by an aircraft, the system being particularly useful as a part of an aircraft instrument landing system employing microwave radiation energy. The antenna array disclosed in that prior patent application provides excellent results, particularly in producing directional beam signals at different azimuth angles which are substantially consistent at different elevations. This characteristic is sometimes referred to as good signal "tracking."

One of the reasons for the good tracking results obtained in the antenna array of the above-mentioned related patent application is that the microwave energy is directed in beams with the energy levels reduced sharply near the horizon to thus minimize signal reflections from the ground plane. However, it has been discovered that the tracking of the different portions of the beams produced by such antenna arrays may be seriously limited at elevations below about 0.5° above the horizon. There are various reasons for this problem, as will be explained more fully below. Furthermore, there are some installations where extremely accurate tracking is very important at elevations extending from about plus 0.5° down into negative elevation angles.

Accordingly, it is an important object of the present invention to provide a method and apparatus which will substantially improve the vertical tracking of directional azimuth navigation signals at low elevation angles and negative elevation angles.

Another object of the invention is to provide an improved microwave radiation method and apparatus which minimizes the effect of physical obstructions upon low angle directional signal components.

Another object of the present invention is to provide an improved microwave radiation method and apparatus which substantially reduces undesired ground reflection effects at low or negative radiation elevation angles.

Further objects and advantages of the invention will be apparent from the following description and the accompanying drawings.

The invention may be carried out in the operation of a radio guidance system for transmitting directional microwave guidance signals in a pattern generally along and just above the horizon such as for the azimuth guidance portion of an instrument landing system, by following the method of overcoming low angle obstruction problems by interposing a radiation screen in the low angle portion of the signal pattern with the upper portion of the radiation screen being terminated in a horizontal diffraction edge which is capable of providing a diffraction pattern of microwave energy at low angles beyond the diffraction edge, and which diffraction pattern is substantially undistorted in azimuth.

Figure 1:
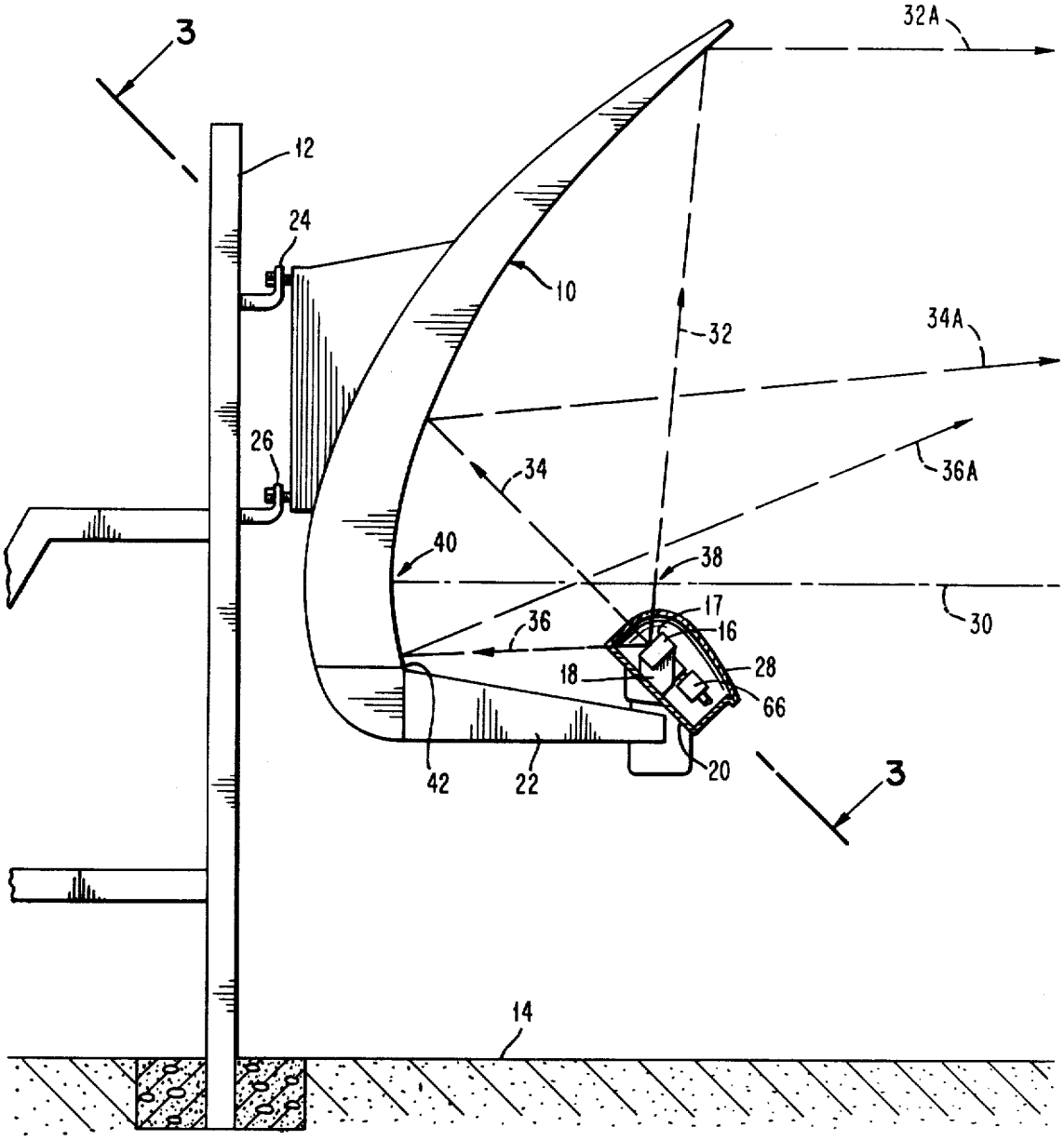
FIG. 1 is a side view, partially in section, of a preferred antenna array which may be used in conjunction with the present invention.

Referring more particularly to FIG. 1, there is shown a side view of an antenna array including a horizontally aligned cylindrical reflector 10 which is mounted and supported upon a suitable supporting frame 12 above a supporting surface, as indicated at 14. The apparatus is normally positioned beyond the roll-out end of the runway which is served, the end opposite to the end approached by an aircraft for landing. This antenna array is preferably constructed in accordance with the teachings of the aforementioned related U.S. Pat. application Ser. No. 453,347.

The antenna array includes a number of radiating elements, preferably consisting of slotted wave guides, indicated at 16 which radiate beams of microwave energy from slotted faces 17 to the reflector 10, as indicated by the dotted lines 32, 34, 36 in the drawing. While there are a number of slotted wave guide radiators at 16, they are generally arranged in a straight line which is parallel to the axis of the cylindrical reflector 10 so that only the near end of the first slotted wave guide radiator is visible in FIG. 1.

The slotted wave guides 16, which may also be referred to as radiating elements, are supported by means of suitable individual supporting brackets 18 upon a common mounting plate 20. Mounting plate 20 is supported upon a pair of booms 22 which are attached to the lower portion of the structure of the reflector 10. Thus, the positions of the slotted wave guides 16 are fixed with relation to the reflector 10 because of the secure mechanical interconnection by the common mounting plate 20 and the booms 22. This entire assembly is suported upon the frame 12 by means of three or more attachments indicated at 24 and 26. Attachments 24 and 26 are preferably designed so that the entire reflector assembly can be precisely adjusted in position with respect to the frame 12 for aiming purposes. The wave guides 16 are preferably enclosed by a synthetic resin cover 28, sometimes referred to as a "randome," (shown in section) which protects them from the elements, but does not interfere with the radiation of microwave energy.

The wave guides 16 are designed to provide separate radiation component beams at different azimuth angles. However, the beams are substantially identical in the elevation aspect, as illustrated in connection with FIG. 1. The reflector 10 has been referred to as a cylindrical reflector. The term "cylindrical," as used in defining this reflector, refers to the broad dictionary definition of the term "cylinder," that is: the surface traced by a straight line, called generatrix or element, moving parallel to a fixed straight line. A large part of the upper portion of reflector 10 represents a modified parabolic cylinder. The reflector is normally positioned so that the axis plane 30 of the parabola is substantially horizontal. This means also that the generation element lines (the different stations of the generatrix which generated the cylindrical surface) are all horizontal. Stated another way, the curvature of the cylindrical surface is exclusively in the vertical dimension.

The following explanation of the structure and operation of the antenna array, including the reflector 10, assumes that the electromagnetic microwave radiation obeys geometrical optical principles of reflection. This is an aid in understanding of the operation of the apparatus. However, it should be understood that there is appreciable diffusion of the microwave radiation so that geometrical optical principles do not explain the operation of the apparatus completely. Furthermore, various factors such as relative phase relationships of the different parts of the radiated beams are also important.

The microwave beams radiated by the slotted wave guides 16 are relatively wide in the elevation dimension as illustrated in FIG. 1. One major function of reflector 10 is to narrow these beams in the elevation dimension. Various illustrative individual portions or elements of the microwave beams are illustrated at 32, 34, and 36. 32 represents very nearly the uppermost portion of the beam, 34 represents the center portion of the beam (aligned with the center-line of the wave guide), and 36 represents the lower marginal edge portion of the beam. While the design may be carried out with many variations, the invention is described in terms of the preferred embodiment. For instance, the mounting plate 20 is preferably supported at an angle of about 45° to the horizontal. Accordingly, the center lines of all of the radiating elements 16, and the center portions 34 of the beams are directed upwardly at an angle of 45° in a common plane. The beam portions 32, 34, and 36 are each reflected from the reflector 10 and result in the respective reflected beam portions 32A, 34A, and 36A.

The focus of the parabolic portion of the reflector 10 is located at, or very near, the intersection of the axis 30 with the beam portion 32, as indicated at 38. It is a characteristic of a parabolic reflector that, insofar as they obey geometrical optical principles, electromagnetic radiations from a point source at the focus of the reflector are reflected in paths which are parallel to the reflector axis. In the present structure, the portion of the microwave radiation represented by line 32 follows this principle. While the radiating elements 16 are located offset from the focus, the offset position is such that the radiation indicated by line 32 is treated by the reflector as though it had originated at the focus since it is aligned in exactly the same direction as it would have been if it originated from the focus. Thus, the reflected beam portion at 32A is exactly horizontal, and parallel to the axis plane 30.

The offset of the radiating elements 16 from the focus of the parabola is somewhat exaggerated in the drawing, and it is preferable to have the radiating elements positioned in the very near vicinity of focus of the parabola.

While the reflector surface is described as a parabola, the configuration is preferably modified somewhat away from a true parabola in order to obtain the desired radiation pattern in elevation with the greatest possible efficiency. For instance, this cylindrical reflector surface is preferably generated in accordance with a formula suggested for the generation of the center line of a spherical microwave reflector in Formula 6 appearing in connection with FIG. 5 on pages 1290 and 1291 of a technical paper by A. S. Dunbar entitled "Calculation of Doubly Curved Reflectors for Shaped Beams" published in the Proceedings of the IRE, volume 36, pp. 1289–1296, October 1948. While the formulas appearing in that article are primarily directed to double curved reflectors, in accordance with the present invention, it has been discovered that the formula for the center line reflector shape is effective for a cylindrical reflector. Following the teachings of that technical paper, the lower sector of the effective portion of the reflector 10 from somewhat above the intersection 40 of the axis 30 with the reflector, and extending down to the lower marginal edge, indicated at 42, may preferably have a sharper curvature, and may merge into a shape more generally corresponding to a circular cylinder sector.

Because of the shape and configuration of the surface of reflector 10, it is apparent that the reflected beam elements such as 36A, 34A, and 32A cross one another in a reversal of these reflected beam elements. Thus, the upper portion of the radiation reflector determines the character of the lower portions of the reflected beams, and the lower portion of the reflector determines the character of the upper portions of the reflected beams. Furthermore, it is apparent that the paths of all of these reflected beam portions lie above the position of the radiating elements 16 so that these directly reflected beam portions are not intercepted by the radiating elements and the associated supporting structures.

Since the focus plane 30 is substantially horizontal, it is quite evident that the reflector 10 may be described as facing in a substantially horizontal direction, and as presenting a concave cylinder surface for the reflection of the microwave energy.

In a preferred physical embodiment used for microwave beams at a frequency in the order of 5,000 MHz, the reflector 10, from the bottom corner 42 to the upper tip of the reflector may have a vertical dimension of 1.85 meters. When properly adjusted, the common center line of the slotted faces 17 of the slotted wave guides 16 may be spaced in the order of 67.3 centimeters horizontally from the bottom corner 42 of the reflector, and 7.6 cm. above the bottom corner 42 of the reflector. The axis plane 30 is spaced vertically upward from the lower corner 42 of the reflector about 23 cm., and the horizontal dimension from the lower tip 42 of the reflective surface to the upper tip of the reflective surface, when the reflector 10 is adjusted with the axis plane 30 horizontal, is about 94 cm.

Figure 2:
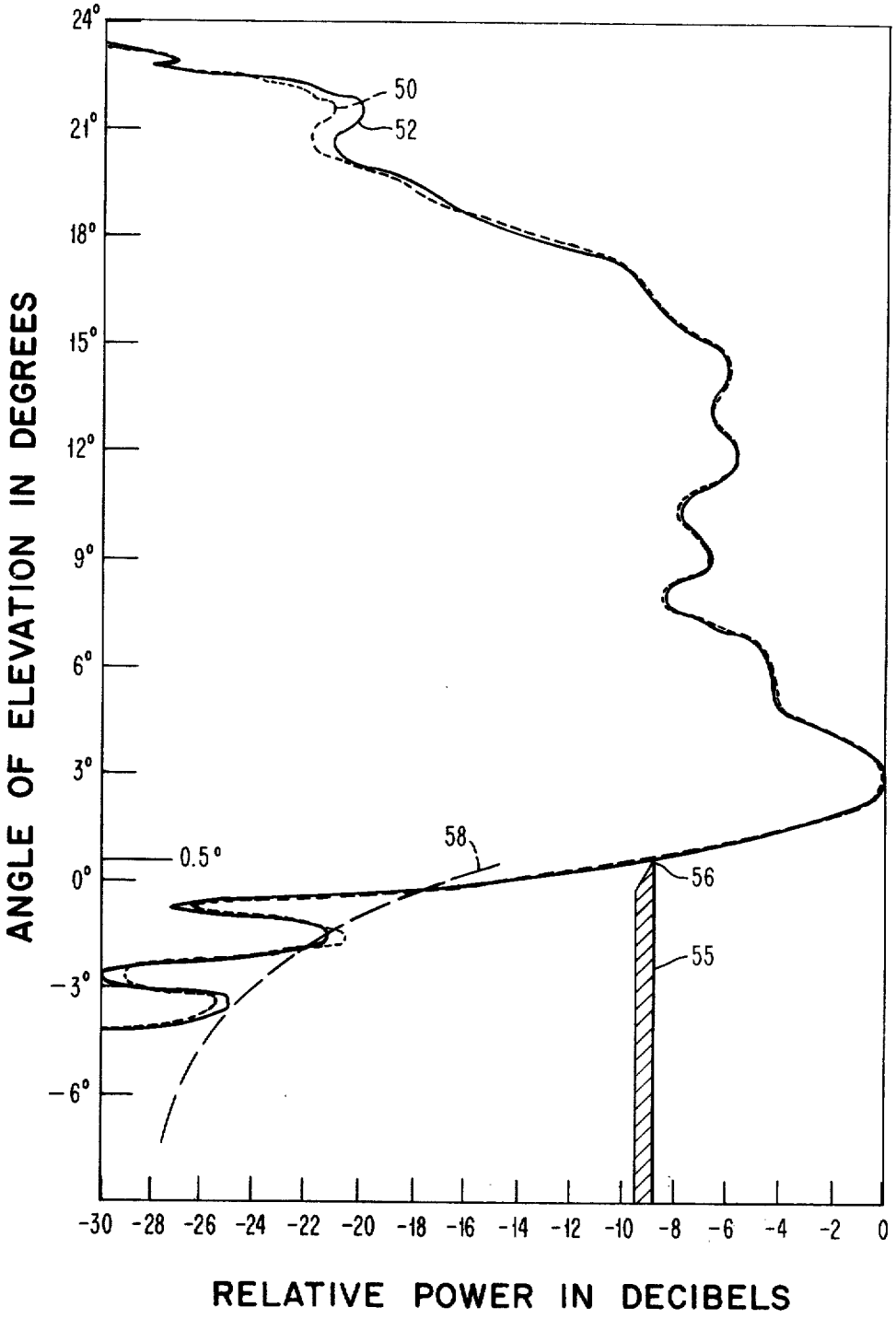
FIG. 2 is a graphic representation of the elevation pattern of signal strength versus elevation angle of two beams obtained from the antenna array of FIG. 1, and illustrating by a third curve how the beams are modified below the elevation angle of plus 0.5° by the presence of the diffraction edge structure.

FIG. 2 illustrates idealized test plots illustrating the signal patterns in terms of signal strength versus angle of elevation for two different beams produced by the structure of FIG. 1 at different azimuth angles. One pattern is shown by a dotted line 50, and the other by a solid line 52. These plotted relative signal strengths were taken at the azimuth center lines for the two azimuth beams aligned most clearly to the azimuth course plane in space defined by the apparatus as described more fully below. These are the beams shown and described below in connection with FIG. 5 and identified as beams 144 and 146.

The shape of the beams in elevation, as determined primarily by the reflector 10, provides a desirable distribution of radiation energy for the purpose of a landing system because the signal strength is the greatest at an elevation of about 3° above the horizon, and there is a rapid fall-off in the beam signal intensities from the three degree elevation to the zero degree elevation (corresponding to the horizon). The three degree angle of maximum signal intensity is desirable because the glide path is typically at about a 3° angle of inclination. Furthermore, it is desirable to have a rapid decrease in the energy intensity in the vicinity of the horizon in order to avoid reflections of radiations from the ground which would reduce the accuracy of the total information received by the aircraft.

The elevation patterns are relatively uniform for all of the different azimuth beams, relatively independently of the azimuth angles and independent of other azimuth pattern characteristics such as beam width. This is because the reflector is a cylindrical reflector, curved only in the vertical direction, and the elevation patterns are determined primarily by the curvature and reflection characteristics of the reflector 10. The close coincidence of the two patterns 50 and 52 shown in FIG. 2 illustrates this principle. On the other hand, since the reflector is not curved in the horizontal direction, the azimuth patterns of the beams are substantially independent of the characteristics of the reflector 10.

It will be observed that the pattens 50 and 52 are quite irregular in the vicinity of zero elevation and into the negative elevation angles. Furthermore, the patterns do not "track" with one another (do not coincide in intensity) at negative angles of elevation. In some installations, it is very important to have uniform beam signals at low and negative elevation angles which track perfectly. Furthermore, other problems causing aberrations in the beams (not illustrated in FIG. 2) may be encountered at low elevation angles below about plus 0.5° elevation.

Therefore, in order to obtain uniform beam characteristics below a predetermined low elevation angle in accordance with the present invention, a diffraction edge structure, schematically illustrated at 55 in FIG. 2, is employed having an upper horizontal diffraction edge 56 which is arranged to intercept all of the beams at the critical elevation. In this instance, the critical elevation is indicated at plus 0.5°. The lower portion of the diffraction edge structure constitutes a radiation obstruction which prevents transmission of radiation directly from the antenna array beyond that obstruction. Accordingly, the only radiation which continues beyond the diffraction edge structure at elevations below the angle of the diffraction edge consists of radiation which impinges upon the diffraction edge 56, and is then diffracted around the edge into the lower elevation angles. The resultant signal levels beyond and below the diffraction edge are as illustrated by the dashed line 58 in FIG. 2. While only one dashed line is shown for purposes of clarity, it will be understood that the uniformity of "tracking" of the various beams is very close, corresponding to the tracking achieved at the level of incidence of the beams upon the diffraction edge 56.

Figure 3:
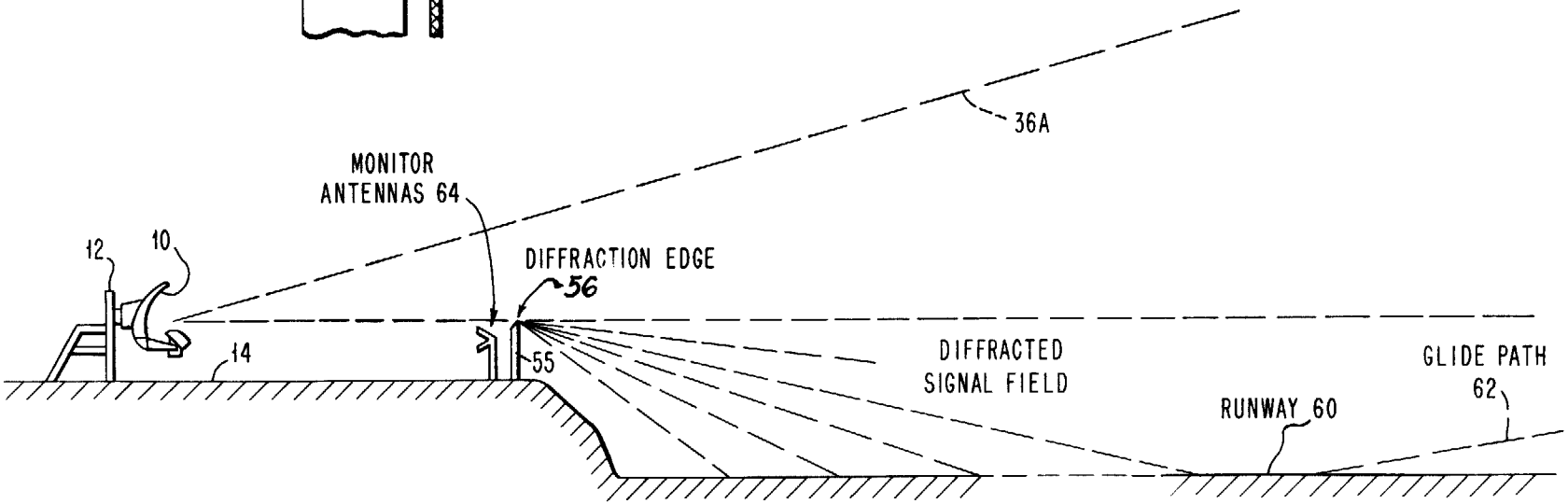
FIG. 3 is a side view of the antenna array of FIG. 1 in combination with the diffraction edge structure of the present invention, and schematically illustrating the resultant positions of the signal field patterns, with exaggerated vertical dimensions, and foreshortened horizontal dimensions.

FIG. 3 is a side view illustrating an actual physical embodiment of the invention showing the antenna array of FIG. 1, including the reflector 10, and the diffraction edge structure 55. From the diffraction edge 56, a series of dotted lines indicates the diffracted signal field at elevation angles below the elevation angle of the diffraction edge 56 with respect to the antenna array at 10. FIG. 3 illustrates an installation of the apparatus where the signal field at low and negative elevation angles is very important because of the fact that the supporting surface 14 for the structure of the antenna 10 is substantially elevated above the aircraft landing field runway indicated at 60. Thus, as the aircraft approaches the runway for an instrument landing on the guide path schematically indicated at 62, the pilot must rely upon localizer signals which are transmitted at negative elevation angles during the final approach and roll-out phases of landing.

In order to promote clarity in the presentation of the concepts of the invention, the vertical dimensions and vertical angles are exaggerated in FIG. 3, and the horizontal dimensions are foreshortened. For instance, the glide path 62 is conventionally at only about 3° above the horizon, but is illustrated in the drawing at a much steeper angle.

While not illustrated in FIG. 3, some of the energy which impinges upon diffraction edge 56 is diffracted upwardly at elevation angles above the elevation angle of the diffraction edge. However, that diffracted energy is not particulary important with respect to the objectives of the present invention, and it is not harmful since it does not appreciably change the total signal available at elevations above the diffraction edge, and does not cause any deterioration in the tracking of the signals of the different beams at those elevation angles.

One of the most important objectives and advantages of the invention is that it completely avoids the transmission of imperfections in the radiation pattern which may exist between the antenna array at 10, and the diffraction edge structure at 55 due to obstructions or other causes. Such obstructions are often unavoidably present. For instance, it is very desirable in radio navigational aids such as instrument landing systems to provide receivers for continuously monitoring the navigation signals to make certain that those signals are not interrupted, and that they are continuously available in proper proportions and with proper modulation from the various different azimuth angles. In a localizer system for instrument landing systems such as those particularly referred to above, such a monitor system is preferably provided in accordance with the teachings of prior U.S. Pat. No. 3,818,476 issued June 18, 1974. Such a monitor system requires the use of a plurality of receiving antennas horizontally spaced out in front of the antenna array at 10. These monitor antennas are schematically indicated at 64 in FIG. 3. Only one monitor antenna is actually shown because the monitor antennas are usually, and preferably, all at the same distance from the transmitter antenna array 10. These monitor antennas must be at elevations which are high enough to intercept a substantial signal intensity portion of each of the directional signal beams. Unfortunately, the monitor antennas also have the practical effect of modifying the patterns of the signals beyond the monitor antennas at elevation angles subtended by the monitor antennas. Accordingly, by placing the diffraction edge 56 at an elevation angle just slightly above the uppermost parts of the monitor antennas 64, the problems of modification of the signal pattern by the monitor antennas are completely avoided. This is because the modified signals are stopped by the diffraction edge structure 55, and replaced by the unmodified and undistorted (in azimuth) diffracted signal field from the diffraction edge 56.

The difficult site illustrated in the drawing is for the situation where there is an abrupt elevation in the terrain just beyond the roll-out end of the runway. While an elevated position for the localizer antenna array is not really desired, the present invention permits such an elevated installation where it is necessary. For instance, it is even possible to install the localizer antenna array on the roof of a building which may already exist near the roll-out end of the runway. The diffraction edge structure 55 is then placed near the front edge of the roof of the building.

As is apparent from FIG. 3, the diffracted signal field (the diffraction pattern) from the diffraction edge 56 does more than simply replace the low angle signal field which would have been available directly from the antenna array at 10 because part of the diffraction pattern fills low angle space near the roll-out end of the runway 60 which could not have been reached by direct radiation from the antenna array at 10 because of being in the shadow of the edge of the hill upon which the antenna array is installed.

The diffraction edge structure 55 may be in the near field of the pattern of signals from the antenna array at 10 and may be effective when placed in the near field. However, the operation of the diffraction edge is much easier to predict if the diffraction edge structure 55 is placed in the far field, or at least at what might be termed the beginning of the far field. The far field may be variously defined as: the distance at which the signals are fully formed, or the distance at which the field strength is accurately inversely proportional to the distance from the antenna array, or far enough from the antenna array so that the signals are substantially free from phase sensitivity.

In a practical system, with an effective vertical aperture of the antenna array at 10 of about 1.09 meters, and with an operating frequency of about 5,000 MHz (wave length 6 centimeters), the preferred minimum distance of the diffraction edge structure from the antenna array at 10 is about 40 meters. This corresponds to the beginning of the far field as determined by the known formula $$\frac{2D^2}{\text{lambda}},$$

where D is the effective aperture, and lambda is the wave length.

However, satisfactory operation has been obtained with a distance from the antenna to the diffraction edge structure of only about 20 meters.

While not illustrated in FIG. 3, it is possible to provide a second diffraction edge structure beyond the diffraction edge structure 55, and at a lower elevation angle with respect to the antenna array at 10. The second diffraction edge structure is then energized from part of the diffracted signal field from the first diffraction edge. The second diffraction edge structure serves the purpose of interrupting any low angle portions of the intercepted diffracted signal field which may be distorted by any physical objects interposed between the two diffraction edge structures, and below the level of a plane extending between the two diffraction edges. For instance, if an automobile highway intervenes between the roll-out end of the runway, and the localizer antenna, then the second diffraction edge structure can be placed on the runway side of the highway so as to eliminate the effects of signal distortions caused by the passage of automobiles on the highway.

While it is preferred to have the monitor antenna 64 inside the diffraction edge structure 55 (between the diffraction edge structure 55 and the antenna array at 10), it is possible to modify the combination so that the monitor antennas 64 are beyond the diffraction edge structure 55 and supplied with part of the diffracted signal field at elevation angles below the diffraction edge 56. This has the virtue that only the lowest portions of the diffracted signal field are modified or distorted by the presence of the monitor antennas. Such portions of the diffracted signal field are generally not so important because they essentially intercept only with the roll-out end of the runway 60.

Figure 4:
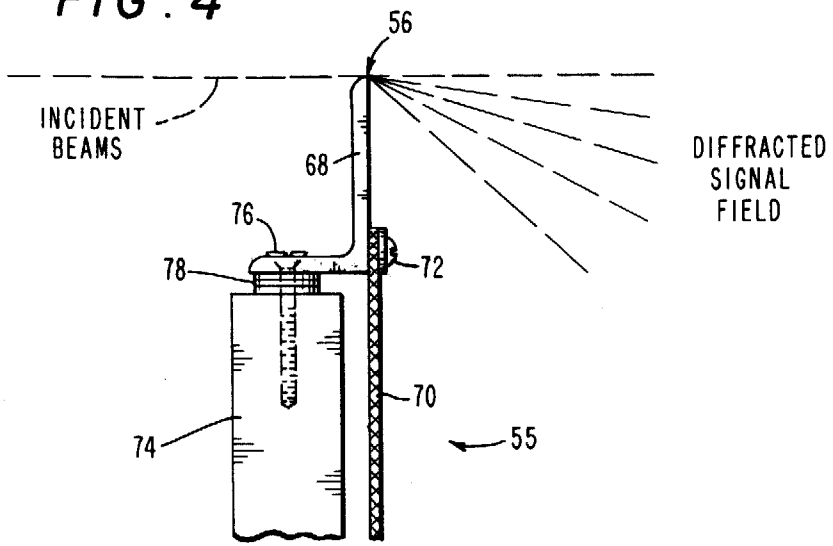
FIG. 4 is an enlarged partial detail end view of a diffraction edge structure used in the combination of FIG. 3.

FIG. 4 illustrates an enlarged detail end view of a preferred physical embodiment of the diffraction edge structure 55 of FIG. 3. As illustrated in this drawing, the diffraction edge 56 is formed by the upper edge of an L-shaped structural steal beam 68. A steel mesh screen material 70 is secured at the upper edge thereof to the structural L-beam 68 by means of suitable fastenings such as screws indicated at 72. The screen mesh 70 preferably extends all the way to the ground level. The entire structure is supported by means of posts 74 which are spaced along the width of the diffraction edge structure, and to which the structural L-beam is fastened by means of screws such as indicated at 76. Adjustments may be made in the vertical dimension between the top of each post 74 and the L-beam 68 by means of suitable shims indicated at 78.

In order to operate as a solid barrier to passage of radiation, the screen material 70 preferably has openings which are in the order of one-tenth of a wave length or less. Thus, at 5,000 megacycles, with a 6 centimeter wave length, the mesh of the screen should be 6 millimeters or less.

The actual construction and the details of the diffraction edge structure 55 are not otherwise particularly critical, except that it is desirable to keep the outward side (to the right in the drawing), that is: the side away from the direction of the antenna array at 10, relatively smooth and uncluttered, and to place the posts 74, and other structural features which may provide irregularities, on the incident beam side of the structure (on the left as illustrated in the drawing).

The upwardly extending leg of the structural L-beam 68, which forms the actual diffraction edge, is preferably narrow in thickness in relation to the wave length of the incident energy. It should be no greater than one-eighth of a wave length in thickness. The structure can be quite light, as long as it is heavy enough to be dimensionally stable in the presence of wind loads, and other weather conditions.

The diffraction edge itself may be made to be particularly sharp by machining the upper edge of the L-beam 68. However, the edge is normally straight and sharp enough for the purposes of the invention as it is orginally fabricated by the steel producer, without the need for such extra machining.

While the edge is shown as a perfectly sharp physical straight edge, it will be understood that the edge may also be formed as a Fresnel edge, with regular rectangular notches cut into the edge, the dimensions of the notches being related to the wave length of the energy to be diffracted.

There are a number of useful variations in the design of the diffraction edge structure. For instance, in order to not only stop, but also to disperse the energy impinging upon the mesh 70, a second mesh may be provided behind the first one, and preferably positioned at an odd number of quarter wave lengths apart. Thus, with a 6 centimeter wave length, the second mesh should be positioned apart from the first one by 1.5 centimeters, or 4.5 centimeters, etc. Another variation in construction which may be employed for the purpose of reducing any adverse effects from back reflections of energy from the mesh 70 may include tilting the diffraction edge structure either down or up with respect to the antenna array. If the structure is tilted down, then any energy reflected from the structure is directed to the ground, and subsequently reflected from the ground up into the space behind the antenna array where it does not cause any harm. If the structure is tilted up with respect to the antenna array, the reflection of energy is directly upwardly into the space behind the antenna array where, again, it is dispersed without doing any harm.

Still another modification involves the use of radiation absorbing material in place of the mesh 70. Such materials for use with microwave radiations are well known and include, for instance, rubberized horse hair, carbon impregnated plastic foam material, and others.

Figure 5:
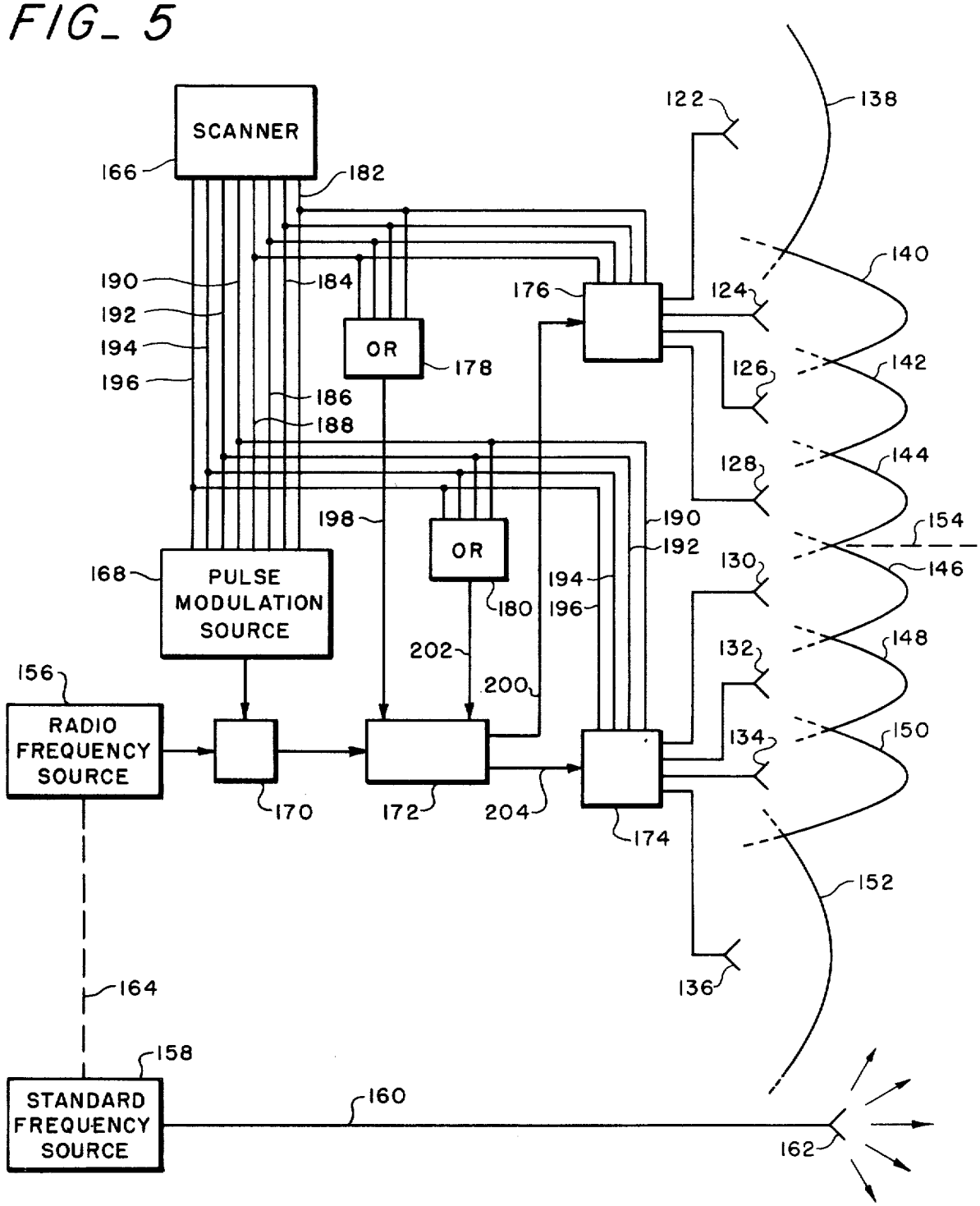
FIG. 5 is a schematic circuit diagram of a transmitter with which the present invention is particularly useful.

FIG. 5 illustrates a schematic circuit diagram of a localizer transmitter which may be employed with the antenna array system serving as the source of microwave radiation in the practice of the present invention. Signals are supplied by the transmitter to the antenna elements (sometimes referred to below simply as "antennas") schematically illustrated in FIG. 5 as separate elements 122–136. These antenna elements are schematically positioned to correlate with their separate contributions to the combined signal pattern which is radiated by the combination of antenna elements.

The antennas 122–136, and the associated beams 138–152, are symmetrically arranged on opposite sides of the course plane in space indicated by the dotted line 154. This is the navigational course lane defined by the transmitter. The radio signals radiated from all of the antenna elements 122–136 are at the same carrier frequency. However, the navigation plane 154 is defined by providing different proportions of modulating frequency tones at 90 and 150 Hz in the respective beams on opposite sides of the plane 154. Thus, the 90 Hz modulation predominates in the beams 144, 142, 140, and 138; and the 150 Hz modulation predominates in the beams 146, 148, 150, and 152. The beams 138–152 are sometimes referred to collectively as constituting a switched scanning beam, and the individual beams 138–152 are referred to as providing individual switched portions of the scanning beam.

Since the transmitter illustrated in this drawing is intended for use for a localizer system, the course plane 154 defined by the navigation signals is a vertical plane for guidance of an aircraft in azimuth. Thus, if an aircraft is approaching the transmitter, it receives guidance signals which are balanced when it is in the navigation plane 154, and which direct it to turn left or right to achieve a course in the guidance plane 154 if it is not in that plane.

The arrangement of the antennas 122–136 and the beams 138–152 in this drawing are schematic representations only. The actual radiation beams are directed radially outwardly in a fan configuration, rather that in a parallel beam configuration as illustrated. The separations of the beams 138–152 in the vertical dimension in this drawing are thus representative of angular separations of the beams in the actual radiation pattern. For instance, typical center to center angular separations between adjacent beams in the central group of beams 140–150 may be 3.6°. Preferred spacings in one embodiment are 3.6° between the center beams 144 and 146, 2.7° from each center beam, such as 146, to the next adjacent side beam 148, and 4.5° to the next further side beam 150. The members of the central group of beams 140–150 are preferably narrow beams having a width of only about 6 degrees. The clearance beams 138 and 152 are of reduced peak energy level, and at wide angles in order to provide a "capture" signal for approaching aircraft and to cover the side lobes of the more central beams.

The various beams are radiated from the various antenna elements 122–136 by rapidly switching radio frequency energy from one antenna element to another. The energy may come from a single radio frequency source 156. This arrangement is referred to as a switched scanning beam system, and it is carried out in accordance with the teachings of a related U.S. Pat. No. 3,774,214 which issued Nov. 20, 1973 for a SCANNING BEAM GUIDANCE METHOD AND SYSTEM, and which is assigned to the same assignee as the present application.

A standard reference frequency signal from a radio frequency source 158 is connected at 160 to radiate from an antenna element 162 (illustrated as a horn 162 in FIG. 3) a standard reference frequency signal for stabilizing and enhancing the discrimination of the aircraft receiver. The horn antenna element 162 provides for a wide angle of transmission, encompassing the entire angular field of the navigation signal beams 138–152, and it is preferably a continuous wave signal in contrast to the discontinuous nature of each of the beams 138–152 of the navigation signals.

The radio frequency source 156 and the standard frequency source 158 may operate completely independently of one another. However, the difference between the frequencies from these two sources must be maintained at a substantially constant value. This may be done by frequently, or constantly, monitoring the frequency difference between the two, or by providing a control connection between the two so that one is controlled by the other. This interrelationship, and possible interconnection, is signified by the dotted line 164.

In addition to the radio frequency source 156, the transmitter system feeding the antennas 122–136 includes a scanner 166, a pulse modulation source 168 controlled by the scanner, and a modulator gate 170 controlled by the pulse modulation source 168. The transmitter also includes gating devices 172, 174, and 176, by means of which the modulated radio frequency signals are gated to the respective antenna elements 122–136. The switches 172–176 are also controlled by the scanner 166. The control of gate 172 is accomplished through logic OR gates 178 and 180. The modulation provided by the pulse modulation source 168 is preferably a pulse duration modulation in which the modulation is synchronized with the scanning of the beam by the switching of the beam from one antenna element to another. Thus, as the radio frequency is switched to each antenna element 122–136, the duration of the pulse (actually a burst of radio frequency energy) is carefully controlled at gate 170 by the pulse modulation source 168 to provide the desired modulation on that particular beam. Since the pattern of modulation to be provided on each of the various beams is constant, there is a complete repetition of the modulation sequence and therefore the different modulation signals required for the diffence sequences of pulses for each beam can be built into the pulse modulation source. Preferably, the pulse modulation is carried out by means of digital circuits and by means of digital synthesis of the modulation in accordance with the teachings of a prior related patent application Ser. No. 198,839, now issued as U.S. Pat. No. 3,798,597.

The scanner 166 is operable to issue timing signals in a sequence on the output lines 182 through 196 to control the gating of energy respectively to the antenna elements 122–136, and to control the operation of the pulse modulation source 168 to provide the appropriate modulation in synchronism with the switching of the energy to the respective antenna elements. The scanner provides an output on only one of the output connections 182–196 at any one time. For instance, at the interval when the scanner provides an output at connection 182, that output is received by the pulse modulation source 168, and also by the OR gate 178 and the switch 176. As a result of the signal received by the OR gate 178, an output is provided from that OR gate on connection 198 to the switching device 172, controlling that switching device to cause the radio frequency energy received from the modulation gate 170 to be switched through connection 200 to the four-way gate 176. Concurrently, the scanner signal on connection 182 received by the four-way switch 176 causes the radio frequency energy to be switched to the antenna element 122. In similar fashion, scanner signals on any one of the outputs 184, 186, and 188 energize the OR gate 178 to switch the radio frequency energy to the switch 176, where that energy is in turn switched respectively to the antenna elements 124, 126, and 128. Similarly, scanner signals on connections 190, 192, 194, and 196, switch the radio frequency energy respectively to the antenna elements 130, 132, 134, and 136. The switches 172, 174, and 176 may be microwave switches of the type referred to as shunt-diode switches, and may employ PIN diodes.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. In the operation of a radio guidance system for transmitting directional microwave guidance signals in a pattern generally along and just above the horizon for the azimuth guidance portion of an instrument landing system, the method of overcoming low angle signal distortion problems by interposing a radiation screen in the low angle portion of the signal pattern and terminating the upper portion of the radiation screen in a horizontal diffraction edge to thereby provide a diffraction pattern of azimuth guidance microwave energy signals at low angles beyond the diffraction edge which is substantially undistorted in azimuth, said diffraction pattern replacing the original low angle portion of the signal pattern intercepted by the radiation screen.

2. A method as claimed in claim 1 wherein the diffraction edge and the associated radiation screen are interposed at an angle of elevation above the elevation angle of physical structures which interfere with the signal pattern and beyond the physical structures in the direction of signal radiation.

3. A method as claimed in claim 1 wherein the horizontal diffraction edge and the associated radiation screen are interposed in the signal pattern at least far enough from the source of the signal pattern to be in the beginning of the far field of the signal pattern.

4. In a microwave directional radiation antenna system with a source of microwave radiation signals forming a directional substantially horizontal signal pattern filling a prescribed volume containing an azimuth guiding path determined by the radiation signals, the improvement comprising a diffraction edge structure including a radiation screen extending upwardly to intercept the low elevation angle portion of said signal pattern, said diffraction edge structure being terminated at the upper portion thereof with a horizontal diffraction edge which is capable of forming a diffraction pattern of microwave radiation beyond said diffraction edge at radiation angles below said diffraction edge which is accurately determined by the microwave signal pattern energy intercepted at said diffraction edge.

5. A system as claimed in claim 4 wherein said diffraction edge structure is positioned far enough from said source of microwave radiation signals to be at least at the beginning of the far field of radiation.

6. A system as claimed in 4 wherein there is provided, in combination, a plurality of signal monitor antennas at separate spaced horizontal positions in the low elevation angle portion of said signal pattern from said source of microwave radiation signals, said monitor antennas being positioned more closely to said source of microwave radiation signals than said diffraction edge structure, and the upper extremities of said monitor antennas being positioned at an elevation angle below the elevation angle of said diffraction edge as determined with respect to said source of microwave radiation signals.

7. A system as claimed in claim 4 wherein said diffraction edge is comprised of a material which has a small thickness dimension in relation to the wave length of the microwave radiation signals which is no greater than one-eighth of a wave length.

8. A system as claimed in claim 4 wherein said diffraction edge structure is substantially smooth on the side opposite to said source of microwave radiation signals.

9. A system as claimed in claim 4 wherein at least the portions of said diffraction edge structure below said diffraction edge are comprised of microwave radiation absorption materials.

10. A system as claimed in claim 4 wherein said source of microwave radiation signals comprises a radiation reflector in the form of a sector of a concave cylinder facing in a substantially horizontal direction towards said diffraction edge structure and including a plurality of slotted wave guide microwave signal radiating elements horizontally positioned and arranged to direct microwave energy directly to said reflector for reflection thereby, said radiating elements being positioned and operable to direct radiation in several separate narrow beams to said reflector at different azimuth angles and such that the center lines of said beams are in substantial alignment in elevation within a common plane, the reflected beams having elevation patterns as determined primarily by the cylindrical curvature and the elevation rotational position of said radiation reflector and having different azimuth angles and selected azimuth patterns symmetrical about the respective center lines thereof.

11. A system as claimed in claim 4 wherein said diffraction edge is mounted at an angular elevation with respect to said source of microwave radiation signals above the elevation angle of physical structures protruding into the low elevation angle portion of said signal pattern.

12. A system as claimed in claim 11 wherein said diffraction edge structure is positioned on the side of said physical structures opposite to said source of microwave radiation signals.

13. A system as claimed in claim 4 wherein at least the portion of said diffraction edge structure beneath said diffraction edge is comprised of a conductive metal mesh sheet material.

14. A system as claimed in claim 13 wherein the interstices of said mesh are no greater that one-tenth of the shortest wave length of said microwave radiation signals.

15. A system as claimed in claim 14 wherein said portions of said diffraction edge structure below said diffraction edge include a second metallic mesh sheet material disposed in parallel with said previously mentioned mesh material at a spacing which is an odd number of quarter waves therefrom.

* * * * *